United States Patent [19]

Toyama

[11] 4,306,484

[45] Dec. 22, 1981

[54] WIND INSTRUMENT

[75] Inventor: Nobuo Toyama, Kamakura, Japan

[73] Assignee: Toyama Musical Instrument Co., Ltd., Tokyo, Japan

[21] Appl. No.: 949,419

[22] Filed: Oct. 3, 1978

[30] Foreign Application Priority Data

Mar. 1, 1978 [JP] Japan ..... 53-23201

[51] Int. Cl.[3] ..... G10D 7/00

[52] U.S. Cl. ..... 84/380 R; 84/380 C; 84/384

[58] Field of Search ..... 84/380 R, 380 C, 382, 84/384

[56] References Cited

U.S. PATENT DOCUMENTS

| | | | |
|---|---|---|---|
| 968,694 | 8/1910 | Rubright | 84/380 R |
| 1,801,690 | 4/1931 | Prueter | 84/382 |
| 1,809,380 | 6/1931 | Gulick | 84/382 |
| 2,208,838 | 7/1940 | Ely | 84/382 |
| 3,487,742 | 1/1970 | Mills | 84/384 |
| 3,643,538 | 2/1972 | Toyama | 84/380 C |
| 3,805,665 | 4/1974 | Oouchi | 84/380 C |

*Primary Examiner*—Lawrence R. Franklin

*Attorney, Agent, or Firm*—Cushman, Darby & Cushman

[57] ABSTRACT

A novel synthetic resin made wind instrument having high rigidity in spite of its thin-walled body portion and capable of producing sympathetic sounds with excellent timbre is provided according to this invention. The wind instrument provided according to the first embodiment of this invention comprises an inner pipe with a small wall thickness, an outer pipe also small in wall thickness, and a plurality of ribs provided in the hollow portion formed between said inner and outer pipes. The outer pipe is press-fitted over the inner pipe so that said both pipes are securely joined to each other. According to the second embodiment of this invention, there is provided a wind instrument composed of an inner pipe, an outer pipe and a plurality of ribs formed therebetween, wherein a rigidity reinforcement layer formed by metal plating or other means is provided in the surface areas defined by the external surface of the inner pipe and the side faces of the ribs. The third embodiment of this invention provides a wind instrument composed of an inner pipe, an outer pipe and a plurality of ribs arranged in the hollow portion formed between said both pipe members, wherein a metal pipe is mounted at the joint portion between the mouthpiece and the barrel or between the barrel and the foot pipe.

7 Claims, 12 Drawing Figures

WIND INSTRUMENT

BACKGROUND OF THE INVENTION

This invention relates to a wind instrument made of a synthetic resin and small in wall thickness of the body portion.

Generally, the synthetic resin made wind instruments have the advantages that they are suited for mass production, inexpensive and tough, but on the other hand they have the drawback that they are unable to produce the sympathetic sounds with soft and beautiful timbre and tone due to the intrinsic physical properties of synthetic resin. With the improvements in molding techniques in recent years, there is seen a tendency in the art of wind instruments to form the pipes small in wall thickness to prevent distortion or strain of the pipes during molding thereof so as to elevate the molding precision of the synthetic resin made wind instruments. It was found, however, that reduction of the wall thickness of the pipes greatly affects the timbre of sympathetic sounds produced by the instrument.

There is therefore required a wind instrument so constructed that it is able to produce sympathetic sounds with excellent timbre even though the synthetic resin made pipes are formed small in wall thickness.

SUMMARY OF THE INVENTION

The present invention provides a synthetic resin made wind instrument composed of a thin-walled inner pipe, a similarly thin-wall outer pipe and a plurality of ribs disposed in the hollow portion formed between said both pipe members, said both pipes being joined together by press-fitting.

In a preferred embodiment of this invention, a rigidity reinforcement layer such as metal plating is provided on the surface areas defined by the external surface of the thin-walled inner pipe and the side faces of the ribs disposed in the hollow portion between both pipe members.

According to another embodiment of this invention, a metal pipe is adapted at the joint between the mouthpiece and the barrel, or between the barrel and the foot pipe.

The ribs provided in the hollow portion between the inner and outer pipes are preferably the radial ribs formed integral with the inner pipe and extending circumferentially, arranged parallel to and suitably spaced-apart from each other.

Such radial ribs extending linearly along the circumference may be substituted with the "ring rims" formed integral with the inner pipe and arranged vertical to the axis while suitably spaced-apart from each other in the axial direction.

It is also possible to provide the ribs formed integral with the inner pipe and extending helically in the axial direction while crossing each other. Furthermore, it is possible to adopt any other forms or designs of ribs which can serve as skeleton members for joining the inner and outer pipes.

Said ribs may not necessarily be provided on the external surface of the inner pipe; they may as well be formed on the internal surface of the outer pipe to accomplish the object of this invention.

Accordingly, the primary object of this invention is to provide a synthetic resin made wind instrument which is capable of producing sympathetic sounds with excellent timbre in spite of the fact that the body portion of the instrument is formed small in wall thickness.

Another object of this invention is to provide a synthetic resin made wind instrument having high dynamic rigidity even though the body portion thereof is small in wall thickness.

Other objects and advantages of this invention will become more apparent from a review of the following detailed description of the invention and the appended claims.

BRIEF DESCRIPTION OF THE DRAWINGS

The characteristic features of this invention will be easily understood from reading the following description of the invention when taken in conjunction with the accompanying drawings which illustrate the preferred embodiments of the invention and in which.

DETAILED DESCRIPTION OF THE INVENTION

Referring first to FIGS. 1 to 4 which diagrammatically illustrate a recorder constructed in accordance with one embodiment of this invention, it will be seen that the recorder 1 is composed principally of a mouthpiece 2, tubular barrel 3 and foot pipe section 4. Each of said mouthpiece 2, barrel 3 and foot pipe section 4 is of a double-wall structure consisting of a thin-walled inner pipe *2i* (*3a*, *4i*) and a similarly thin-walled outer pipe *2o* (*3o*, *4o*) each of which is made of a synthetic resin (such as a thermoplastic synthetic resin). Each inner pipe is small and uniform in wall thickness, and on the back side thereof are formed integral ribs *2i′*, *3i′*, *4i′* provided for the purpose of joining.

Figure 1:
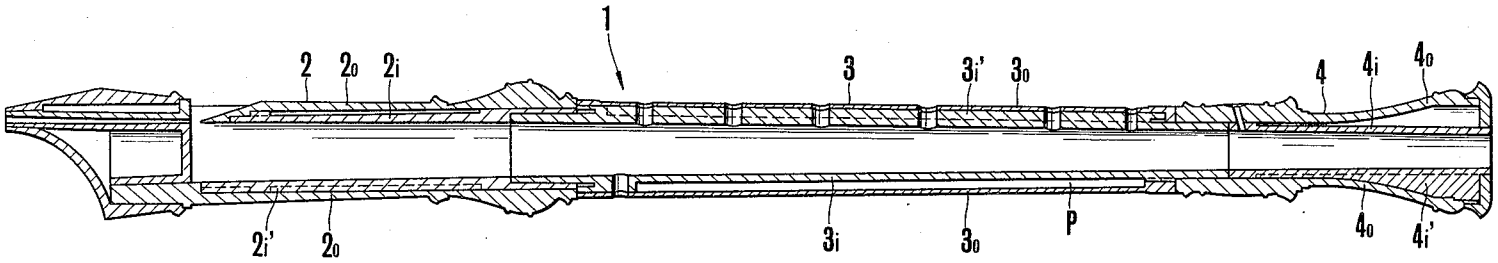
FIG. 1 is an axial sectional view of a recorder constructed in accordance with one embodiment of this invention.
Figure 2:
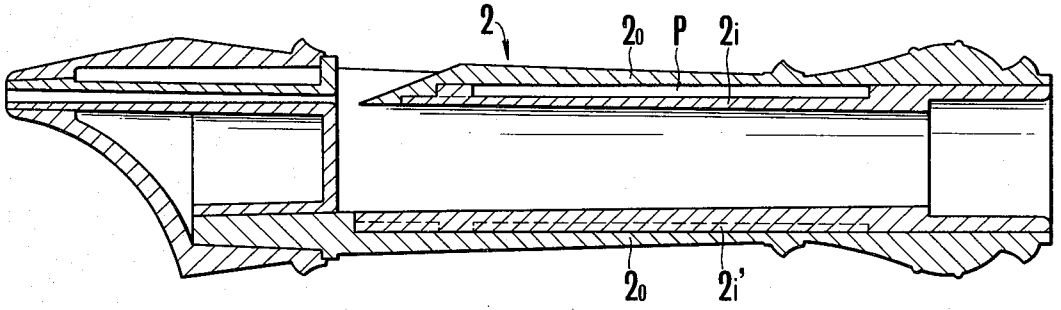
FIG. 2 is an axial sectional view of the mouthpiece of the recorder shown in FIG. 1, FIG. 2 being shown on a larger scale than FIG. 1.
Figure 3:
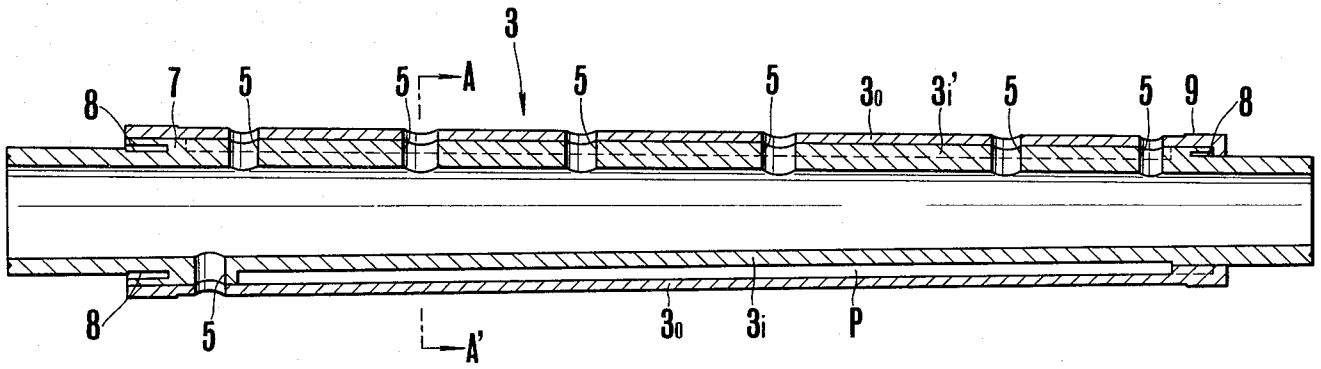
FIG. 3 is a sectional view of the barrel portion of the recorder shown in FIG. 1, illustrating a condition where the rims of the inner and outer pipes have been press-fitted to combine said both pipes.
Figure 3A:
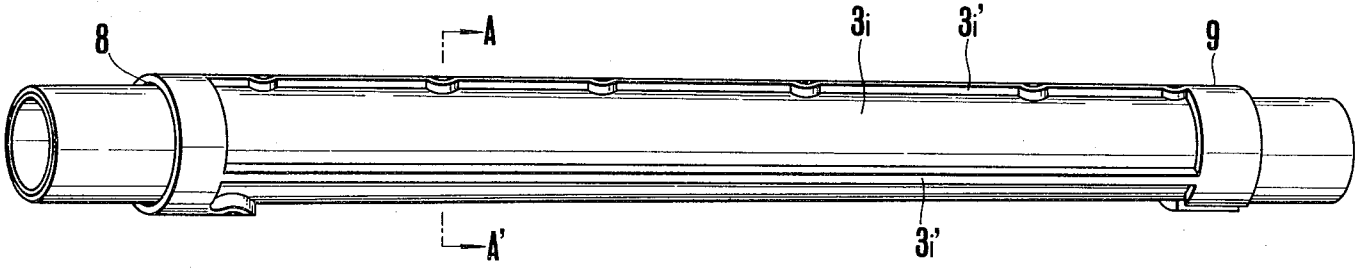
FIG. 3A is a perspective view of the inner pipe of the barrel portion shown in FIG. 3.
Figure 3B:
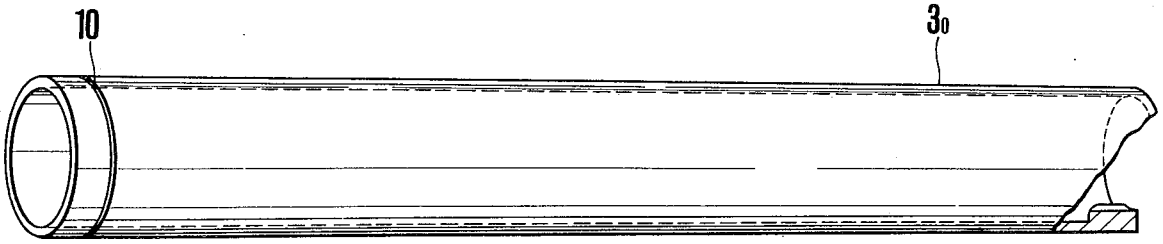
FIG. 3B is a perspective view of the outer pipe of the barrel portion shown in FIG. 3, with parts cut out.
Figure 3D:
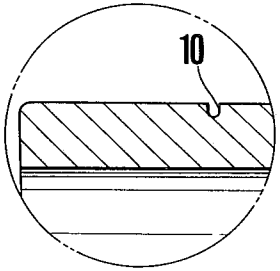
FIG. 3D is a partial enlarged axial sectional view of an annular groove provided at the left end of the outer pipe.
Figure 3C:
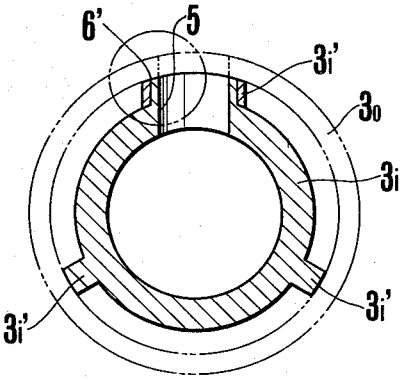
FIG. 3C is a cross-sectional view of the inner pipe of FIGS. 3 and 3A as taken along the line A—A′, this drawing being shown on a somewhat larger scale.
Figure 4:
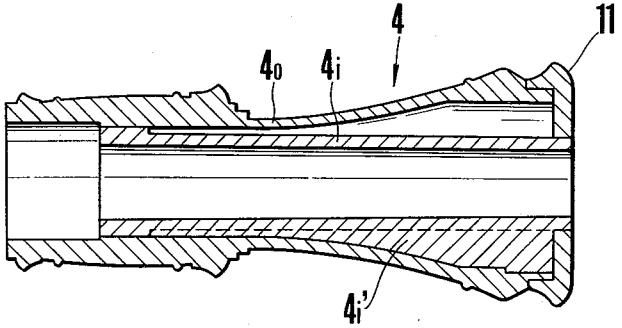
FIG. 4 is an axial sectional view of the foot pipe of the recorder shown in FIG. 1.

An enlarged view of the mouthpiece having the inner pipe *2i* with the protuberant integral ribs *2i* on its external surface is shown in FIG. 2, and an enlarged view of the barrel 3 having the inner pipe 3*i* with the protuberant integral ribs 3*i*' on its external surface is shown in FIG. 3. FIG. 3A is a perspective view of said inner pipe 3*i*, and FIG. 3B is a perspective view of the outer pipe in the barrel. This outer pipe is press-fitted on the inner pipe of FIG. 3A to constitute the barrel of the instrument as shown in FIG. 3. FIG. 4 is an enlarged view of the foot pipe 4 having the ribs 4*i*' formed integral therewith. The inner and outer pipes of both mouthpiece and foot pipe are constructed similar to those of the barrel shown in FIGS. 3A and 3B, and the outer pipe is press-fitted on the inner pipe to constitute the structures shown in FIGS. 2 and 4. As shown in FIG. 3, tone holes 5 are formed in the inner pipe ribs 3*i*' and the corresponding parts of the outer pipe. The rib 3*i*' formed with a tone hole 5 shown in FIG. 3C is of a double-wall structure as further described later, but it may have other structure.

The inner pipe 3*i* and the outer pipe 3*o* are pressfitted to ensure airtightness around the joint 6' of the outer pipe 3*o* and the inner pipe ribs 3*i*'.

A rigidity reinforcement layer by metal plating such as nickel or silver plating is provided on the surface areas between the external surface of the inner pipe 3*i* and the ribs 3*i*' to increase rigidity of the tubular body portion of the instrument.

This rigidity reinforcement is also provided on the areas between the inner pipe ribs 2*i*' of the mouthpiece 2 and between the inner pipe ribs 4*i*' of the foot pipe portion 4.

The joint portions at both ends of the barrel are thick-walled as in the conventional products, but a cut 8 is provided in the thick-walled portion 7 to prevent development of strain during cooling and hardening.

Metal pipes 9 are secured to both ends of the barrel 3 where the inner and outer pipes 3*i* and 3*o* are joined tightly to each other. One edge of each said metal pipe is embedded into a recession 10 formed in the outer pipe 3*o* as shown in FIG. 3B. The other edge is also similarly embedded into a recession (not shown) formed in the wall of the outer pipe. These metal pipes 9 are adapted to strengthen the joint portion to give the same reinforcing effect as by metal plating between the ribs.

Thus, in the recorder constructed according to this invention as described above, ribs are formed integral with the thin-walled inner pipe and this inner pipe is press-fitted with the outer pipe to join them integrally, so that the inner pipe is strongly supported by the outer pipe to provide the instrument with sufficient rigidity. Therefore, in case of using a soft synthetic resin as the molding material of this instrument, it is possible to prevent deterioration of timbre or quality of sympathetic sounds that would otherwise result from lessening of wall thickness attempted to avoid generation of strain during cooling and hardening. There is thus provided according to this invention a recorder which is capable of producing sympathetic sounds with excellent timbre as well as clear and serene sounds. Further, as it is possible to additively employ the step of providing a rigidity reinforcement layer such as metal plating on the surface of the inner pipe, rigidity of the recorder body can be further increased. Moreover, since metal pipes are securely fitted at the joints between the barrel and mouthpiece and between the barrel and foot pipe, a same reinforcing effect as provided by metal plating between the ribs is given at the joints.

Figure 5:
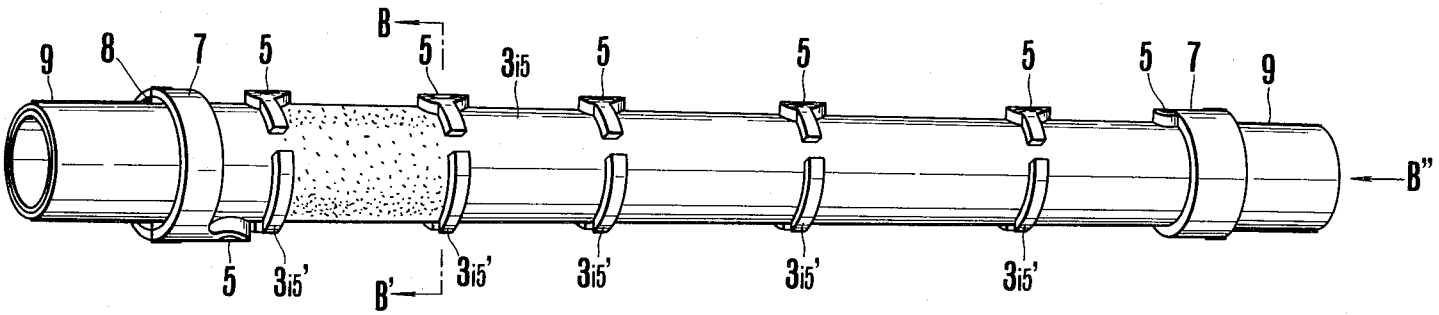
FIG. 5 is a perspective view of the inner pipe constituting the barrel portion of the recorder constructed according to another embodiment of this invention.
Figure 5B:
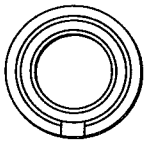
FIG. 5B is a side view of the inner pipe of FIG. 5 as taken in the direction of arrow B″.
Figure 5A:
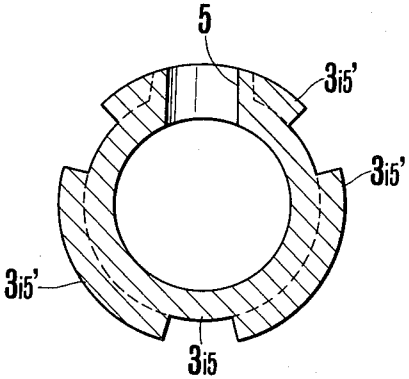
FIG. 5A is a sectional view, taken along the line B–B′, of the inner pipe shown in FIG. 5.

In the above-described embodiment of this invention, there are provided the ribs extending parallel to the pipe axis, but such ribs may be arranged circumferentially, either regularly or irregularly, while suitably spaced-apart from each other in the axial direction as shown in FIG. 5.

Figure 6:
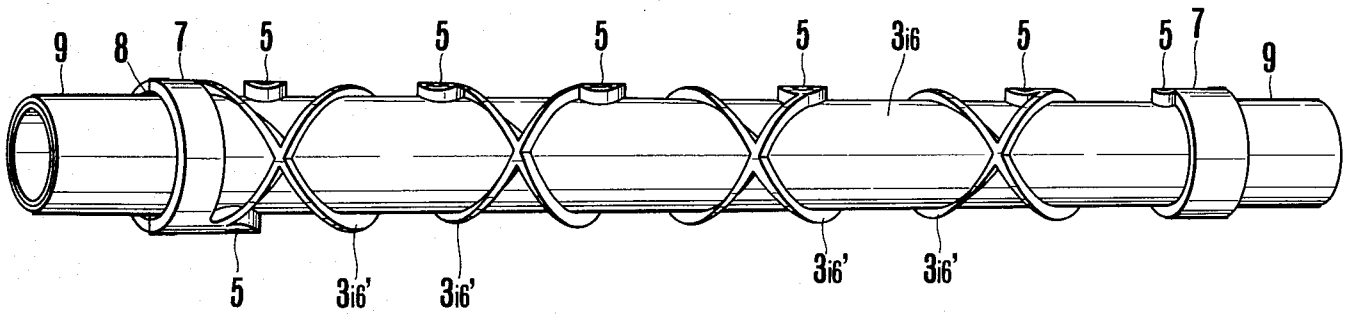
FIG. 6 is a perspective view showing the inner pipe of the barrel portion of a recorder constructed in accordance with still another embodiment of this invention.

The ribs may be also so arranged as to cross each other obliquely as shown in FIG. 6.

Although the inner pipe of the barrel portion alone is shown in FIG. 5, it will be appreciated that the outer pipe is press-fitted with the inner pipe similarly in the mouthpiece and foot pipe portion as well. In FIG. 5, the inner pipe is indicated by sign $3i_5$ and the ribs by sign $3i_5'$. Other reference numerals correspond to those in FIG. 3. Similar denotation is also used in FIG. 6 where sign $3i_6$ indicates the inner pipe and sign $3i_6'$ indicates the ribs.

In these embodiments, the ribs are provided protuberant radially and integrally with the inner pipe, but similar ribs may be formed integral with the outer pipe. Instead of forming the ribs integral with one or both of the inner and outer pipes, one may produce the inner and outer pipes separately from each other, forming the ribpassing holes in or securing the ribs to one or both of said pipes so as to fulfill the purpose of giving rigidity, and then press-fit the outer pipe on the inner pipe. In case of forming the ribs on the outer pipe, the rib-passing holes may be formed in the thick-walled portions 7 of the inner pipe or other thick-walled portions may be provided on the outer pipe.

In case the ribs are formed separately, such ribs are secured in the thick-walled portions other than said thick-walled portions 7 of the inner pipe. It will be understood that the thick-walled portions (other than the said ones of the inner pipe) provided on the outer pipe together with the ribs can play the role of ribs in this invention.

Although the tone holes formed in the ribs in the above-described embodiments are of a single-wall structure, the same effect can be obtained by forming each said tone hole from a double-wall structure as shown by 6' in FIG. 3C, with the outer wall being made of a soft synthetic resin.

Proper selection of thickness of metal plating and metal pipes will allow further improvement of the recorder rigidity and even better accoustic sympathy.

Although the instrument body rigidity reinforcing means is provided in all of the mouthpiece, barrel and foot pipe portions in the foregoing embodiment of this invention, such means may be provided in only one or two of said portions.

While the present invention has been described by way of its embodiment as adapted to a recorder, this invention can as well be applied to other types of wind instruments such as flute, "shakuhachi" (five-holed bamboo clarinet), etc., or the Western wind instruments such as clarinet, oboe, bassoon (fagotto), etc.

As described above, it is possible with this invention to obtain a wind instrument which is extremely high in rigidity and minimized in strain in spite of the fact that both inner and outer pipes are made of a soft resin material with a small wall thickness, with the body rigidity being further improved by use of metal plating or metal pipes at need, and which is also high in precision and capable of producing sympathetic sounds with excellent timbre.

The foregoing description and the accompanying drawings are merely intended to facilitate understanding of this invention, and it will be understood that various changes and modifications can be suitably made in the described construction of this invention without departing from the spirit of this invention and the scope of its claims.

What is claimed is:

1. A body for a wind musical instrument, comprising:
a thin-walled inner pipe made of a synthetic resin;
a thin-walled outer pipe made of a synthetic resin;
a plurality of ribs located between said pipes forming a closed, hollow portion between said pipes; and
said pipes being joined together by press-fitting.

2. A body as defined in claim 1 wherein said ribs are formed integrally with one of said pipes and wherein the surface areas defined by the external surface of said inner pipe and the side surfaces of said ribs are metal plated to form a rigidity reinforcing layer.

3. A wind instrument according to claim 1 or 2, wherein a ring of a soft synthetic resin material is fitted around the cylindrical wall of each tone hole formed extending radially from the inner pipe.

4. A wind instrument according to claim 1 or 2, wherein said ribs include ribs arranged to extend parallel to the axis and suitably spaced-apart from each other.

5. A wind instrument according to claim 1 or 2, wherein said ribs include the ring-shaped ribs arranged vertical to the axis and suitably spaced-apart from each other.

6. A wind instrument according to claim 1 or 2, wherein said ribs include two strips of ribs extending spirally in the axial direction while crossing each other obliquely.

7. A wind instrument according to claim 1 or 2, wherein a cut is provided in each thick-walled portion of the inner pipe or outer pipe.

* * * * *